US012599846B1

(12) United States Patent
Espinosa

(10) Patent No.: US 12,599,846 B1
(45) Date of Patent: Apr. 14, 2026

(54) BULL SKULL WITH SMOKE DISPENSING SYSTEM

(71) Applicant: ETLC TRADEMARKS, LLC, Miami, FL (US)

(72) Inventor: Aldo Espinosa, Miami, FL (US)

(73) Assignee: ETLC TRADEMARKS, LLC, Miami, FL (US)

( * ) Notice: Subject to any disclaimer, the term of this patent is extended or adjusted under 35 U.S.C. 154(b) by 327 days.

(21) Appl. No.: 18/476,897

(22) Filed: Sep. 28, 2023

(51) Int. Cl.
*A63J 5/02* (2006.01)
*A63H 33/28* (2006.01)

(52) U.S. Cl.
CPC ..... *A63J 5/025* (2013.01); *A63H 33/28* (2013.01)

(58) Field of Classification Search
CPC ..... A63J 5/025; A63H 33/28
USPC ..... 446/24, 475; 472/65, 57
See application file for complete search history.

(56) References Cited

U.S. PATENT DOCUMENTS 764,023 A * 7/1904 Wenzel ..... A63H 33/28 446/297
1,143,458 A * 6/1915 Stern ..... A63H 33/28 446/24
1,572,409 A * 2/1926 Oldham ..... A63H 33/28 446/24
1,683,760 A * 9/1928 Conners ..... G09F 19/10 40/407
1,816,139 A * 7/1931 Aster ..... A24F 13/30 131/179
1,822,511 A * 9/1931 Stone ..... G09F 19/08 40/407
1,983,013 A * 12/1934 Aster ..... A24F 13/30 131/216
2,070,038 A * 2/1937 Batt ..... A63J 5/025 392/397
2,912,790 A * 11/1959 Weeber ..... A63H 33/28 446/18
3,244,641 A * 4/1966 Strittmatter ..... B05B 7/0012 239/77
3,272,510 A * 9/1966 Ohlund ..... F41J 5/24 222/399

(Continued)

FOREIGN PATENT DOCUMENTS

CN 102553272 A * 7/2012
CN 108295492 A * 7/2018 ..... A63J 5/025

(Continued)

*Primary Examiner* — Alexander R Niconovich
(74) *Attorney, Agent, or Firm* — Albert Bordas, Esq.

(57) ABSTRACT

A smoke dispensing system integrated into at least one bull head. The bull head has horns, eye holes, and a nose hole. A pressurized tank assembly, connection assembly, at least one valve, gas tank assembly, and computer produce smoke. The connection assembly connects the pressurized tank assembly to the gas tank assembly and the gas tank assembly to the at least one valve. The pressurized tank assembly pushes gaseous nitrogen or CO2 out of the gas tank assembly. The at least one valve controls the release of smoke produced by the nitrogen or CO2, remotely operated through a computer. The wall assembly serves as a stable mounting point for at least one bull head. When activated, the at least one valve releases smoke from the at least one bull head, creating a visually captivating and customizable experience. The integration of these components provides a unique and dynamic artwork experience.

16 Claims, 3 Drawing Sheets

(56) References Cited

U.S. PATENT DOCUMENTS 4,741,717 A * 5/1988 Wolf ..... A63H 3/48 446/485
4,836,452 A * 6/1989 Fox ..... B05B 7/0012 239/338
5,069,230 A * 12/1991 Green ..... F23B 1/38 131/330
5,240,648 A * 8/1993 Gill ..... B01F 23/21 417/372
5,331,822 A * 7/1994 Belliveau ..... A63J 5/025 62/384
5,667,419 A * 9/1997 Spector ..... F41B 9/004 446/72
5,676,886 A * 10/1997 Fleming ..... F24F 6/00 55/DIG. 15
5,711,481 A * 1/1998 MacDonald ..... A63J 5/025 62/52.1
5,957,382 A * 9/1999 Thomas ..... F41H 9/06 239/14.1
6,280,278 B1 * 8/2001 Wells ..... A63H 19/14 446/25
6,400,897 B1 * 6/2002 Lin ..... F04B 9/14 392/405
6,415,799 B1 * 7/2002 Tuzzolino, Jr. ..... A24F 19/10 40/407
6,416,377 B1 * 7/2002 Bart ..... A63H 33/28 446/15
6,421,502 B1 * 7/2002 Aronie ..... A63H 33/28 392/404
6,430,940 B1 * 8/2002 Gonzalez ..... F17C 9/00 62/52.1
6,817,951 B2 * 11/2004 Levine ..... A63H 33/28 206/217
7,086,920 B2 * 8/2006 Fusco ..... A63H 33/28 446/15
7,963,507 B2 * 6/2011 Scully ..... B05B 7/0012 261/119.1
9,267,677 B2 * 2/2016 Batts ..... F41H 9/06
10,207,195 B2 * 2/2019 Xu ..... A63J 5/02
10,232,283 B2 * 3/2019 Liao ..... F23D 3/02
10,500,520 B2 * 12/2019 Pogue ..... A63J 5/025
11,536,541 B2 * 12/2022 Webberley ..... G01N 15/06
11,541,324 B2 * 1/2023 Chang ..... A63J 5/025
11,628,377 B2 * 4/2023 Pogue ..... A63J 5/025 472/65
11,826,670 B1 * 11/2023 Thai ..... A63H 11/10
2002/0094744 A1 * 7/2002 Cheng ..... A63H 33/28 446/15
2010/0108777 A1 * 5/2010 O'Brien ..... A63J 5/025 239/8
2010/0142933 A1 * 6/2010 Vandoninck ..... F41H 9/06 392/386
2012/0201522 A1 * 8/2012 Stauffer ..... A63J 5/025 392/386
2013/0217293 A1 * 8/2013 Burguieres ..... A63H 33/28 446/24
2015/0014430 A1 * 1/2015 Scully ..... B05B 7/1686 239/8
2016/0370151 A1 * 12/2016 Batts ..... F41H 9/06
2023/0166198 A1 * 6/2023 Inoko ..... A63H 33/28 446/15
2023/0277953 A1 * 9/2023 Kelly ..... A63H 33/22 446/15

FOREIGN PATENT DOCUMENTS

CN 222998276 U * 6/2025
WO WO-0183065 A1 * 11/2001 ..... F42B 4/20

* cited by examiner

BULL SKULL WITH SMOKE DISPENSING SYSTEM

BACKGROUND OF THE INVENTION

The present invention relates to smoke dispensing systems, and more particularly, to smoke dispensing systems with at least one bull head skull.

PRIOR ART

Applicant is not aware of any art that depicts the novelties of the present invention.

SUMMARY OF THE INVENTION

A bull skull with a smoke dispensing system comprising a pressurized tank assembly, a gas tank assembly, a connection assembly, at least one valve, and at least one bull skull.

The connection assembly connects the pressurized tank assembly to the gas tank assembly and connects the gas tank assembly to the at least one valve. The connection assembly extends out of a valve exit. The connection assembly has at least one end and at least one nozzle. The connection assembly comprises a connection line which is flexible.

The pressurized tank assembly pushes nitrogen or CO2 out of the gas tank assembly. Pressurized tank assembly comprises a tank regulator to monitor the pressure in the pressurized tank assembly. The at least one valve is remotely operated, opening and closing as desired. When opened, the pressurized nitrogen or CO2 exits the at least one valve and shoots out of the at least one nozzle, creating smoke.

The at least one valve is controlled by a computer chip. The computer chip can open and close the at least one valve and offers the ability to set the at least one valve on a timed setting for predetermined activations. This computer chip receives remote signals from a computer. In a preferred embodiment, the at least one valve itself is an electronically actuated solenoid valve. In a preferred embodiment, the at least one valve is configured to release the pressurized nitrogen or CO2 in bursts, creating a pulsating smoke effect. The computer allows adjustments of the smoke release duration and intensity.

Gas tank assembly comprises at least one gas tank regulator for the gas tank assembly to maintain the nitrogen or CO2 at a predetermined pressure. The gas tank assembly is designed to be refillable for repeated use.

The visible cloud emitted from the bull skull can be colored or scented, enhancing the visual or olfactory experience. Additionally, the bull skull includes detachable horns, providing customization and variation in appearance.

It is therefore one of the main objects of the present invention to provide a bull skull with a smoke dispensing system that creates a visually stunning and immersive experience.

It is another object of this invention to provide a pressurized tank assembly that efficiently stores pressurized gas to dispense smoke.

It is another object of this invention to provide a connection assembly that securely connects the pressurized tank assembly to the gas tank assembly and facilitates the flow of gasses.

It is another object of this invention to provide a valve that enables remote control of the smoke release, allowing for precise timing and intensity adjustments.

It is another object of this invention to provide a bull skull with smoke dispensing system that is volumetrically efficient for carrying, transporting, and storage.

It is another object of this invention to provide a bull skull with smoke dispensing system, which is of a durable and reliable construction.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF DRAWINGS

With the above and other related objects in view, the invention consists in the details of construction and combination of parts as will be more fully understood from the following description, when read in conjunction with the accompanying drawings in which.

DETAILED DESCRIPTION OF THE INVENTION

Figure 1:
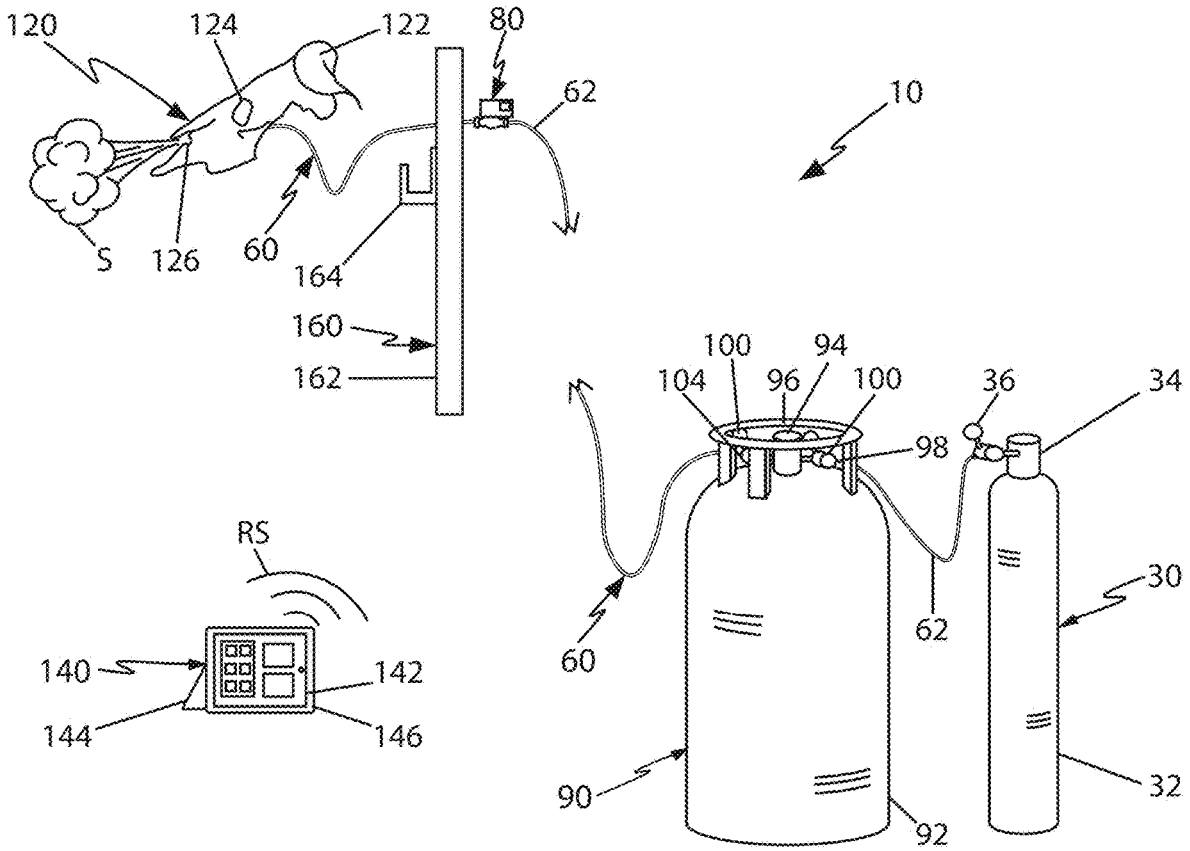
FIG. 1 is an illustration of the present invention.

Referring now to the drawings, the present invention is a bull head skull with smoke dispensing system and is generally referred to with numeral 10. It can be observed that it basically includes pressurized tank assembly 30, connection assembly 60, at least one valve 80, gas tank assembly 90, and at least one bull head 120.

Figure 2:
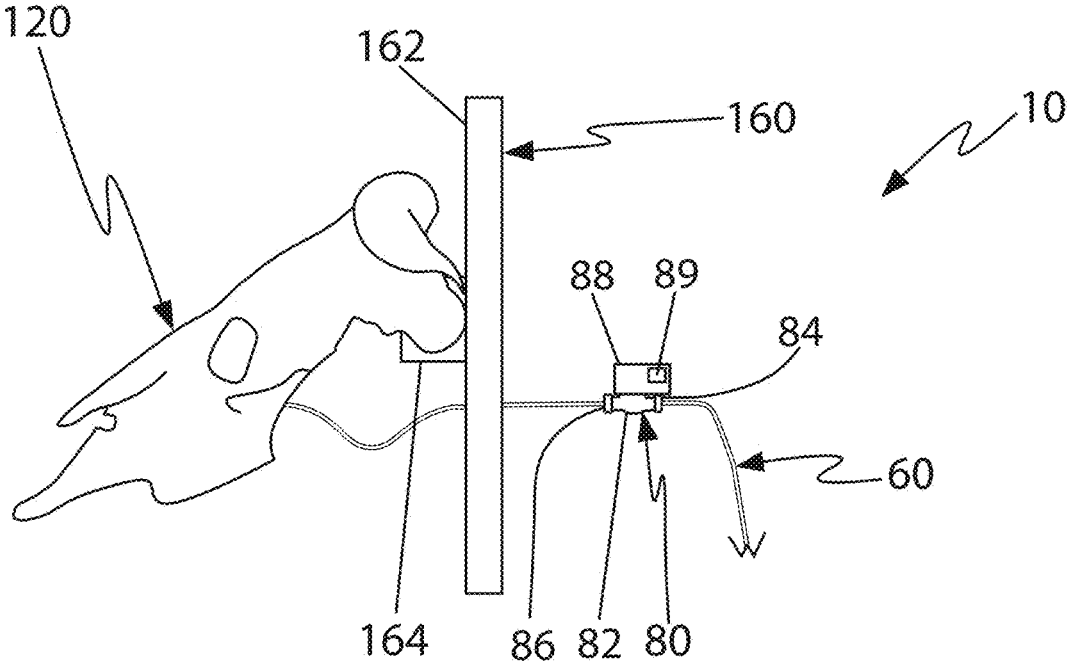
FIG. 2 is a side view of a bull skull of the present invention mounted onto a wall assembly.

As seen in FIGS. 1 and 2, present invention 10 comprises at least one bull head 120, which serves as a focal point in an establishment such as, but not limited to, a restaurant. More specifically, bull head 120 is a bull head, or a bull skull as is illustrated in the figures. At least one bull head 120 comprises bull horns 122. Bull horns 122 detach, which allow for customization and variation in appearance. At least one bull head 120 comprises eye holes 124 and nose holes 126. At predetermined times, smoke S exits nose holes 126.

Pressurized tank assembly 30 comprises tank 32, tank head 34, and tank regulator 36. These components work together to store and control pressurized gas. Pressurized tank assembly 30 is refillable, allowing for repeated use.

Connection assembly 60 connects pressurized tank assembly 30 to gas tank assembly 90, and gas tank assembly 90 to at least one valve 80.

In a preferred embodiment, gas tank assembly 90 contains liquid nitrogen or CO2, and maintains it at a predetermined pressure. Gas tank assembly 90 comprises gas tank body 92, gas tank head 94, gas tank handles 96, gas tank inlet 98, gas tank regulators 100, and gas tank outlet 104. Gas tank assembly 90 is refillable, allowing for repeated use. Pressure from pressurized tank assembly 30 pushes nitrogen or CO2 out of gas tank assembly 90, through connection assembly 60. At least one valve 80 can be opened or closed. When at least one valve 80 is opened, nitrogen or CO2 is released out of at least one bull head 120, and out of nose holes 126. The dispensing of the nitrogen or CO2 chills the air around it, creating smoke S.

Computer 140 is used as a control interface for present invention 10. It includes computer screen 142, computer stand 144, computer case 146, and sends remote signals RS to at least one valve 80 to operate it. Computer 140 allows users to adjust a release duration and intensity of smoke S, providing a customizable experience. In a preferred embodiment, computer 140 can be a computer tablet.

Figure 3:
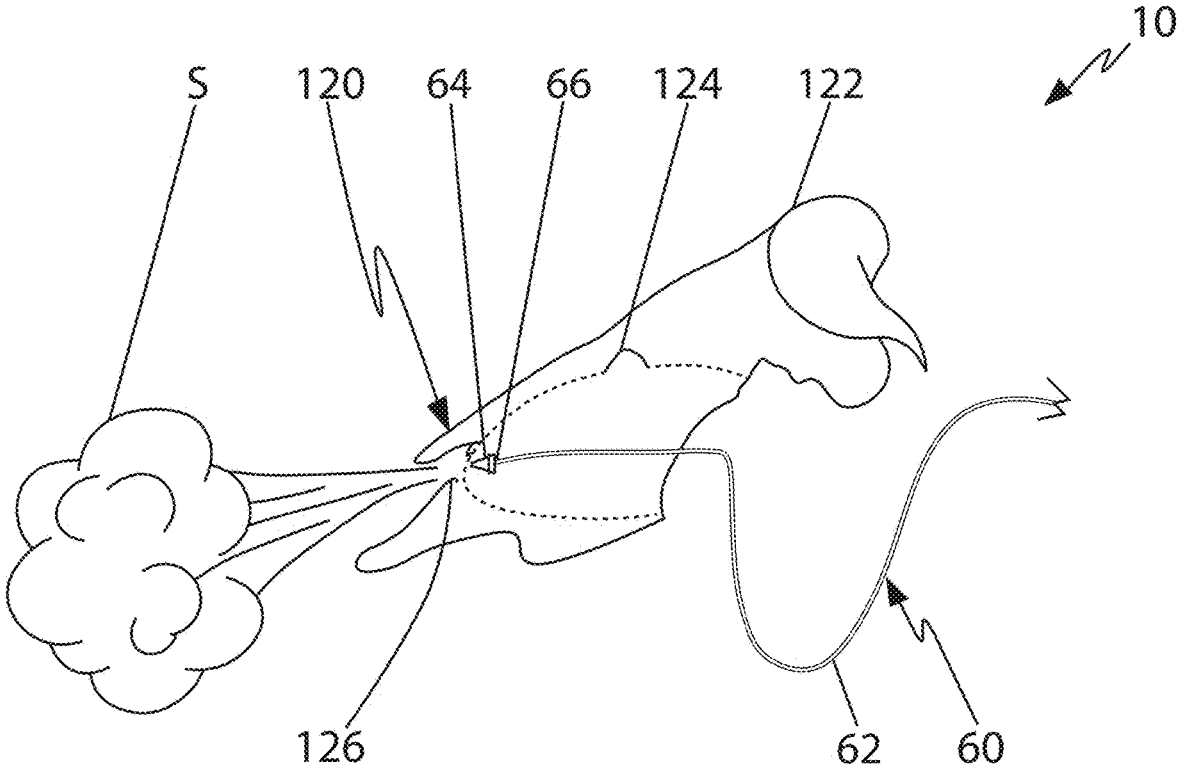
FIG. 3 is a side cutout view of the bull skull while it is dispensing smoke.

As best seen in FIG. 2, at least one valve 80 controls the release of smoke S, seen in FIG. 3. At least one valve 80 comprises valve body 82, valve inlet 84, valve exit 86, and valve control box 88. In one embodiment, valve control box 88 comprises a computer chip 89, which can receive remote signals RS from computer 140, seen in FIG. 1. Computer chip 89 can also control the actuation of at least one valve 80. At least one valve 80 can be remotely operated, either manually with a switch, or through computer 140 to computer chip 89 communication. Smoke S is released from at least one bull head 120 when at least one valve 80 is opened, creating a visually impressive effect. Smoke S can be colored and/or scented, enhancing a visual or olfactory experience.

Figure 4:
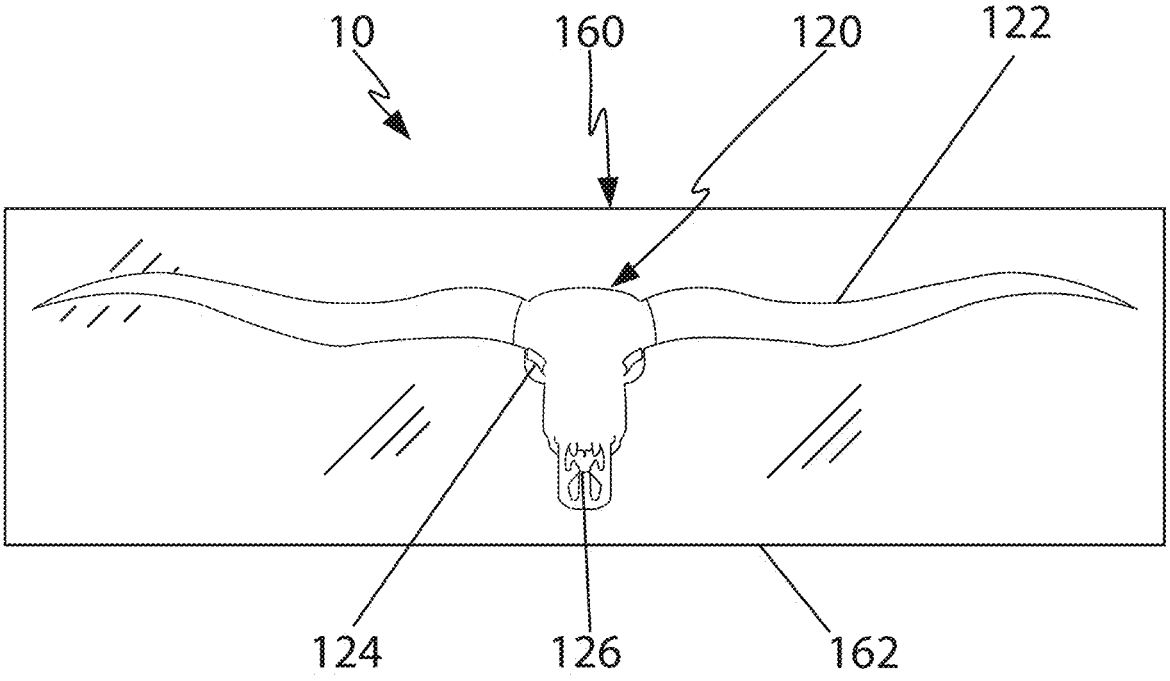
FIG. 4 is a front view of the bull skull mounted onto the wall assembly.

As seen in FIGS. 2, 3, and 4, present invention 10 is visually impressive when assembled. In a preferred embodiment, at least one bull head 120 is visible to patrons and clients, while the interworking of the process for releasing smoke S is hidden behind wall assembly 160. Wall assembly 160 comprises wall 162 and wall mount 164. Wall assembly 160 ensures stability and proper display of at least one bull head 120.

Connection assembly 60 comprises connection line 62, at least one nozzle 64, and at least one end 66. Connection line 62 is a tubular structure that can withstand pressure and temperature variations of pressurized nitrogen or CO2. In one embodiment, connection line 62 is flexible. Connection assembly 60 ensures a proper flow of gas from pressurized tank assembly 30, seen in FIG. 1, to at least one end 66. Smoke S dispenses out of at least one nozzle 64 and exits nose holes 126.

At least one bull head 120 may be mounted on wall assembly 160 for display purposes. The combination of these components in present invention 10 provides a dynamic and visually captivating display, with at least one bull head 120 as the centerpiece, emitting smoke S that can be controlled and customized through computer 140, seen in FIG. 1. At least one valve 80 is configured to release smoke S in bursts to create pulsating effect.

Present invention 10 can be operated at predetermined times or during special events. Additionally, present invention 10 serves as a captivating advertising tool, eliciting excitement at venues such as restaurants and establishing a reputation. Present invention 10 evokes strong emotions in users, resulting in increased patronage and customer spending. This heightened engagement leads to enhanced profitability.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A bull head with a smoke dispensing system, comprising:

A) a pressurized tank assembly;

B) a gas tank assembly comprising gas tank body, a gas tank head, gas tank handles, a gas tank inlet, and a gas tank outlet;

C) a connection assembly comprising at least one nozzle, and at least one end;

D) at least one valve comprising a valve body, a valve inlet, a valve exit, and valve control box having a computer chip, wherein said at least one valve, when opened, releases smoke, said pressurized tank assembly, said gas tank assembly, said connection assembly, and said at least one valve are positioned at a first side of a wall assembly, wherein said wall assembly comprises a wall, and a wall mount; and E) at least one bull head mounted onto a second side of said wall assembly opposite to said first side, said at least one bull head comprises eye holes and nose holes, said at least one end of said connection assembly is in said at least one bull head, whereby said smoke exits by said nose holes, wherein said at least one bull head is a bull skull.

2. The bull head with a smoke dispensing system set forth in claim 1, wherein said pressurized tank assembly pressurizes said connection assembly.

3. The bull head with a smoke dispensing system set forth in claim 1, wherein said connection assembly connects said pressurized tank assembly to said gas tank assembly.

4. The bull head with a smoke dispensing system set forth in claim 1, wherein said connection assembly connects said gas tank assembly to said at least one valve.

5. The bull head with a smoke dispensing system set forth in claim 1, wherein said at least one valve opens and closes remotely.

6. The bull head with a smoke dispensing system set forth in claim 1, wherein said at least one computer chip controls said at least one valve and receives remote signals from a computer.

7. The bull head with a smoke dispensing system set forth in claim 1, wherein said at least one computer chip is programmed to open and close said at least one valve at predetermined times.

8. The bull head with a smoke dispensing system set forth in claim 1, wherein said pressurized tank assembly comprises a tank regulator to monitor pressure in said pressurized tank assembly.

9. The bull head with a smoke dispensing system set forth in claim 1, wherein said gas tank assembly comprises at least one gas tank regulator to monitor pressure in said gas tank assembly.

10. The bull head with a smoke dispensing system set forth in claim 1, wherein said connection assembly to said at least one valve comprises a connection line, wherein said connection line is flexible.

11. The bull head with a smoke dispensing system set forth in claim 1, wherein said gas tank assembly is refillable for repeated use.

12. The bull head with a smoke dispensing system set forth in claim 1, wherein said gas tank assembly is filled with nitrogen or CO2.

13. The bull head with a smoke dispensing system set forth in claim 1, wherein said computer chip is programmed to adjust duration and intensity of release of said smoke.

14. The bull head with a smoke dispensing system set forth in claim 1, wherein said at least one valve is configured to release said smoke in bursts to create pulsating effect.

15. The bull head with a smoke dispensing system set forth in claim 1, wherein said smoke is colored and/or scented.

16. The bull head with a smoke dispensing system set forth in claim 1, wherein said at least one bull head comprises detachable horns to allow customization and variation in appearance.

* * * * *